US010899508B1

(12) United States Patent
Laible

(10) Patent No.: US 10,899,508 B1
(45) Date of Patent: Jan. 26, 2021

(54) OVERMOLDED TRICUSPID VALVE FOR A CONTAINER

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 0 days.

(21) Appl. No.: 16/934,148

(22) Filed: Jul. 21, 2020

(51) Int. Cl.
*B67D 3/00* (2006.01)
*B65D 47/20* (2006.01)

(52) U.S. Cl.
CPC ..... *B65D 47/2031* (2013.01); *B67D 3/0032* (2013.01)

(58) Field of Classification Search
CPC ..... B67D 3/00; B67D 3/02; B67D 3/0029; B67D 3/0032; F16K 15/147
USPC ..... 141/363, 364, 319, 330, 351; 222/448, 222/518
See application file for complete search history.

(56) References Cited

U.S. PATENT DOCUMENTS 3,084,823 A * 4/1963 Reichstein ..... B65D 39/04 215/311
5,202,093 A * 4/1993 Cloyd ..... B01L 3/50825 215/247
5,273,545 A * 12/1993 Hunt ..... A61B 17/3498 137/849
5,323,832 A * 6/1994 Burrows ..... B67D 1/1243 222/1
6,716,396 B1 * 4/2004 Anderson ..... B01L 3/0275 215/232
6,945,432 B2 9/2005 Laible
6,945,433 B2 9/2005 Laible
6,986,433 B2 1/2006 Laible
7,727,474 B2 * 6/2010 Krause ..... B01L 3/022 422/513
7,832,599 B2 11/2010 Laible
7,841,492 B2 11/2010 Laible
8,066,157 B2 11/2011 Laible
8,220,665 B2 7/2012 Laible
8,931,522 B2 * 1/2015 Paige ..... A45F 3/16 141/2
10,058,481 B1 * 8/2018 Russo ..... B65D 51/00
2005/0167391 A1 * 8/2005 Michiels ..... B65D 47/2031 215/303

* cited by examiner

*Primary Examiner* — Frederick C Nicolas
*Assistant Examiner* — Randall A Gruby
(74) *Attorney, Agent, or Firm* — Dennis L. Thomte; Thomte Patent Law Office LLC

(57) ABSTRACT

An overmolded tricuspid valve for use in a container having a throat. The valve is inserted into the throat of the container and permits liquid from flowing from the container during shipment or storage. The container is inverted when used with a dosing and/or dispensing apparatus. The valve remains closed until it is opened by an upward force to permit liquid to flow from the container to the dosing and/or dispensing apparatus. The valve closes when the upward force is removed.

2 Claims, 7 Drawing Sheets

OVERMOLDED TRICUSPID VALVE FOR A CONTAINER

BACKGROUND OF THE INVENTION

Field of the Invention

This invention relates to an overmolded tricuspid valve, which is inserted into the throat of a liquid container, to prevent liquid from leaking from the container during transport and storage of the container. Further, this invention relates to an overmolded tricuspid valve which may be opened to permit liquid to flow therefrom by gravity when the container is inverted. Additionally, this invention relates to an overmolded tricuspid valve which has fewer components than most prior art container valves.

Description of the Related Art

Applicant has received several patents relating to dosing and/or dispensing systems, such as: U.S. Pat. Nos. 6,945,432; 6,945,433; 6,986,433; 7,832,599; 7,841,492; 8,066,157; and 8,220,665, the disclosures of which are incorporated herein by reference thereto to complete this disclosure if necessary.

In most of the above patents, a throat plug assembly was inserted into the throat of a liquid container to prevent liquid from flowing from the container when the container was shipped or stowed. The throat plug assemblies of Applicant's patents set forth above performed in an excellent manner and were commercially successful. However, the throat plugs of Applicant's previous patents were comprised of several parts resulting in increased costs to produce the same. Additionally, some of Applicant's previous throat plug assemblies were not completely recyclable.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A normally closed overmolded tricuspid valve is provided for use in the throat of a liquid container. When the container is being shipped or stored, the valve of this invention prevents liquid from leaking from the container. When the container is inverted and being used with a dispensing and/or dosing apparatus, the normally closed valve prevents liquid from flowing downwardly therethrough to the dispensing and/or dosing apparatus. When the valve is selectively subjected to an upward tearing force by a lance of the dispensing and/or dosing apparatus, the valve is opened to permit liquid to flow from the container to the dispensing and/or dosing apparatus. When the upward tearing force is discontinued, the valve closes.

It is therefore a principal object of the invention to provide a valve for a liquid container which is comprised of fewer components than prior art container valves.

A further object of the invention is to provide an overmolded tricuspid valve for a liquid container.

Yet another object of the invention is to provide an overmolded tricuspid valve for a liquid container for supplying liquid to a dispensing and/or dosing apparatus.

Still another object of the invention is to provide an overmolded tricuspid valve which is completely recyclable.

Still another object of the invention is to provide an overmolded tricuspid valve which is efficient in operation.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

Figure 1:
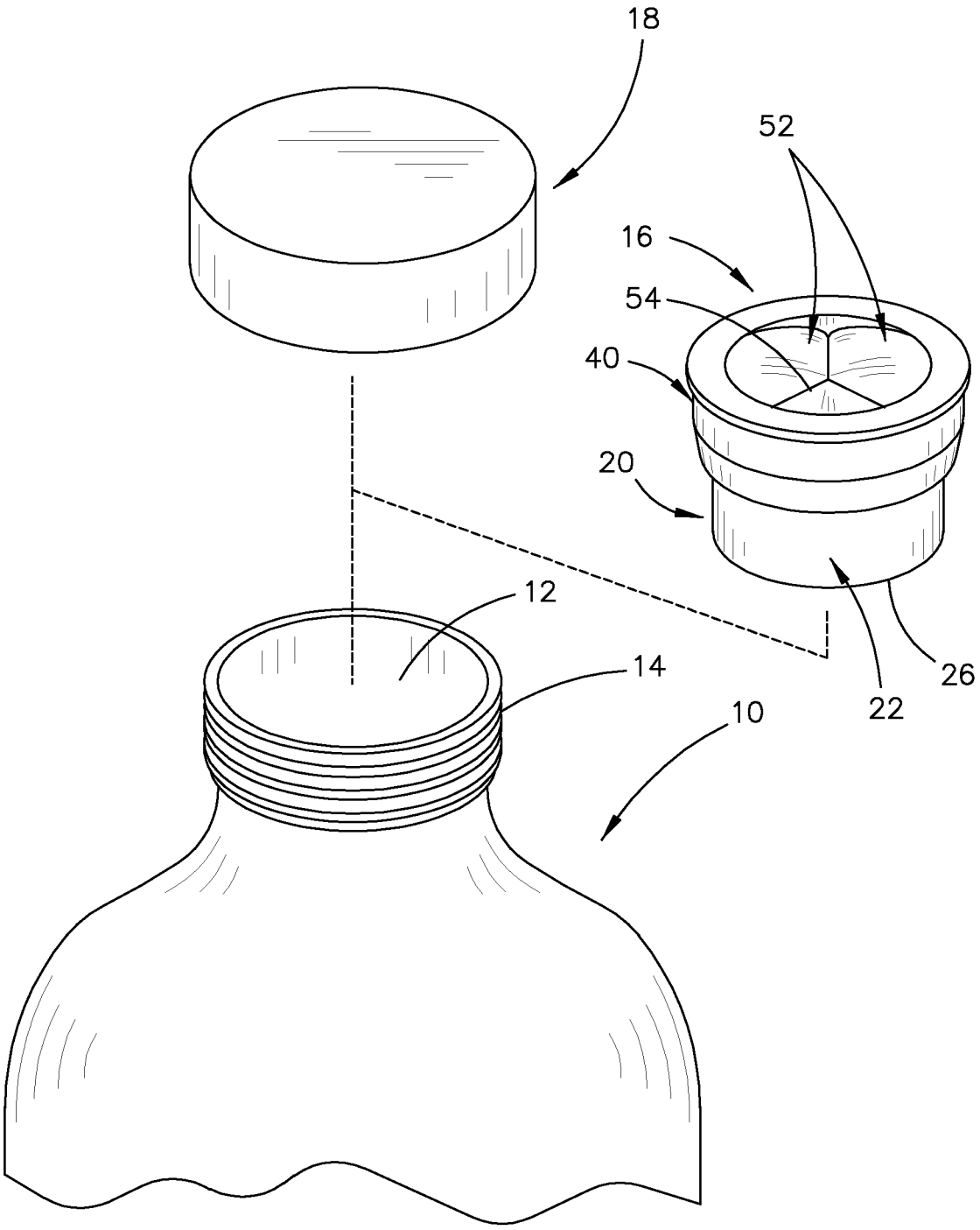
FIG. 1 is a partial exploded perspective view of the overmolded tricuspid valve of this invention, a liquid container and a shipping cap.
Figure 2:
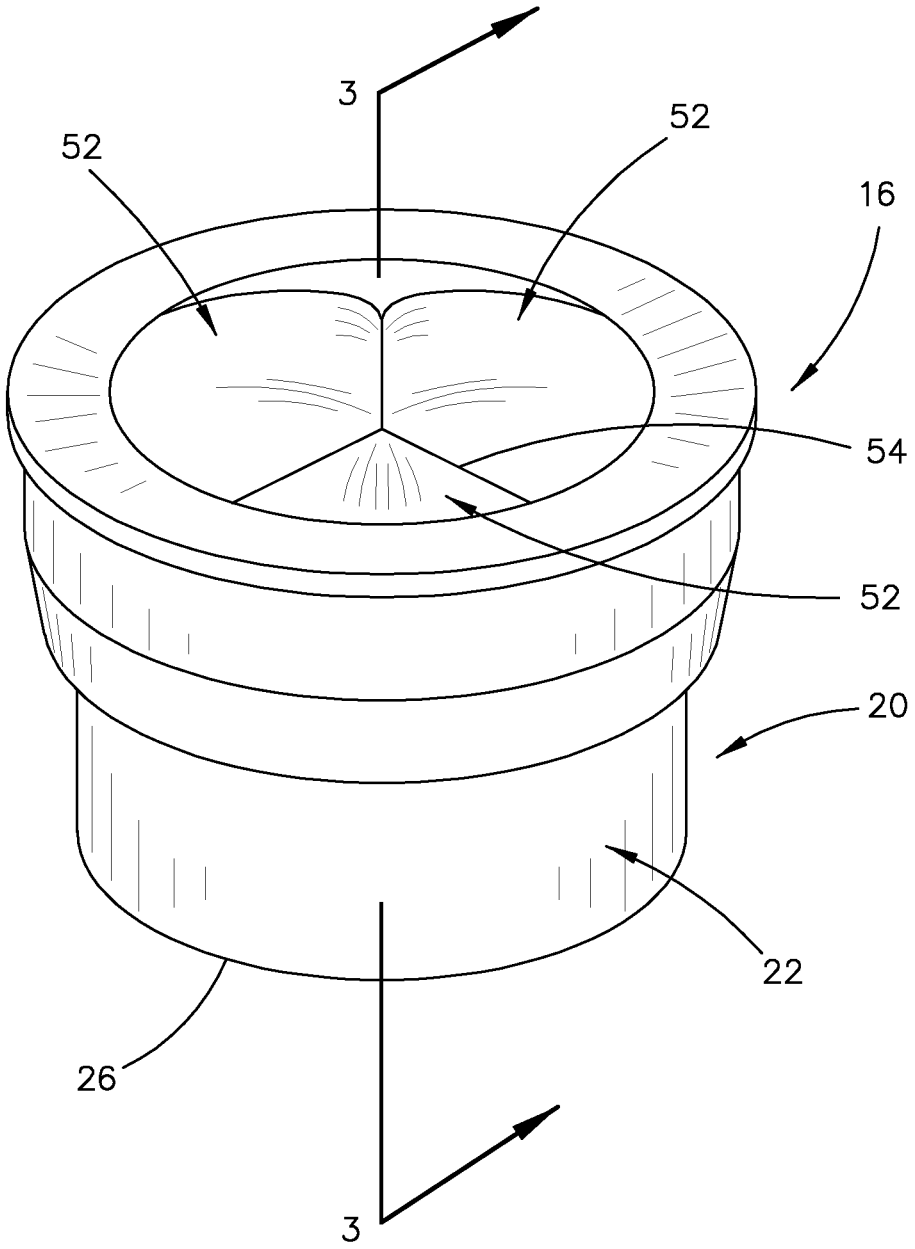
FIG. 2 is an upper perspective view of the overmolded tricuspid valve of this invention.
Figure 3:
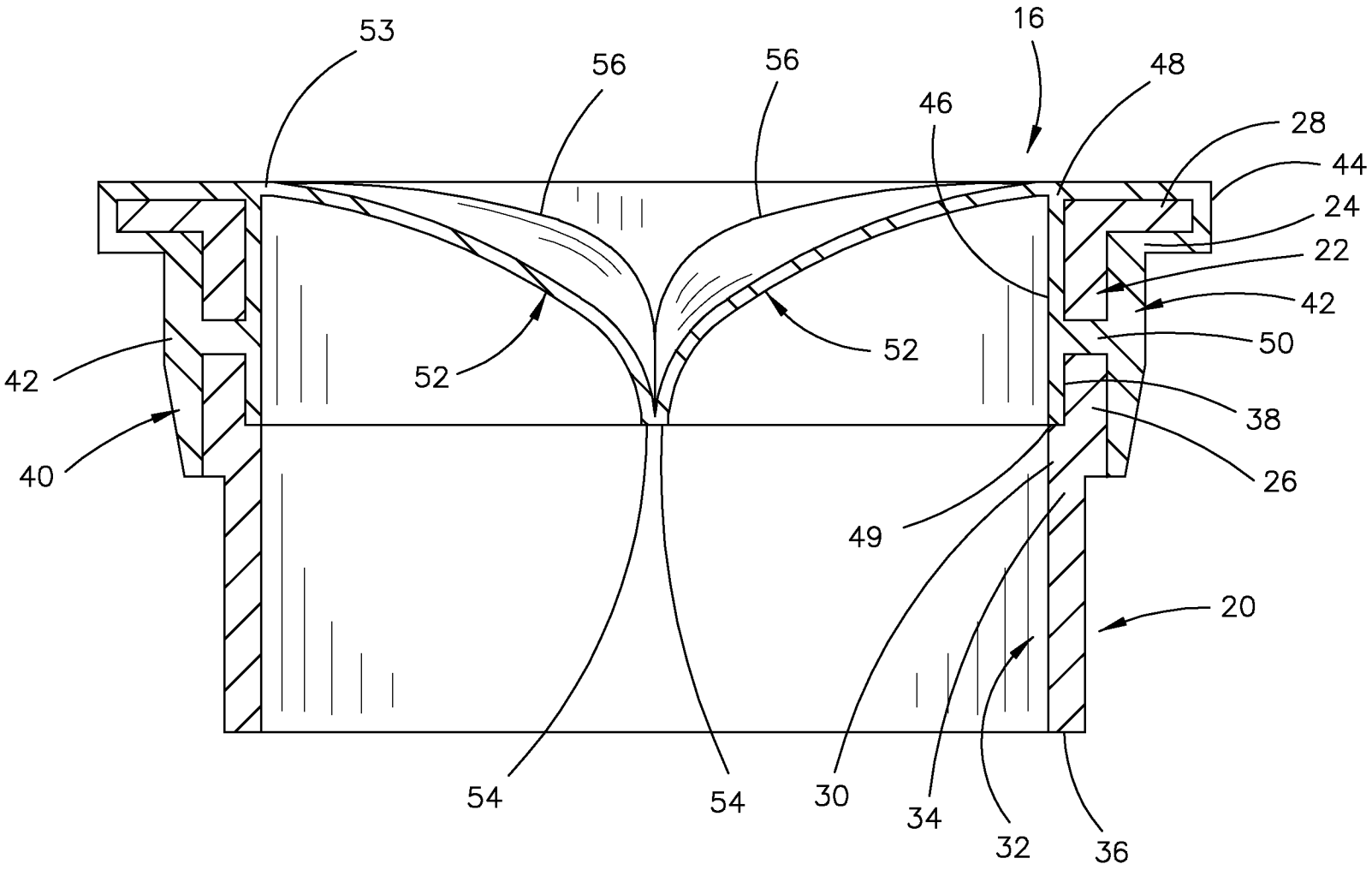
FIG. 3 is a sectional view as seen on lines 3-3 of FIG. 2.
Figure 4:
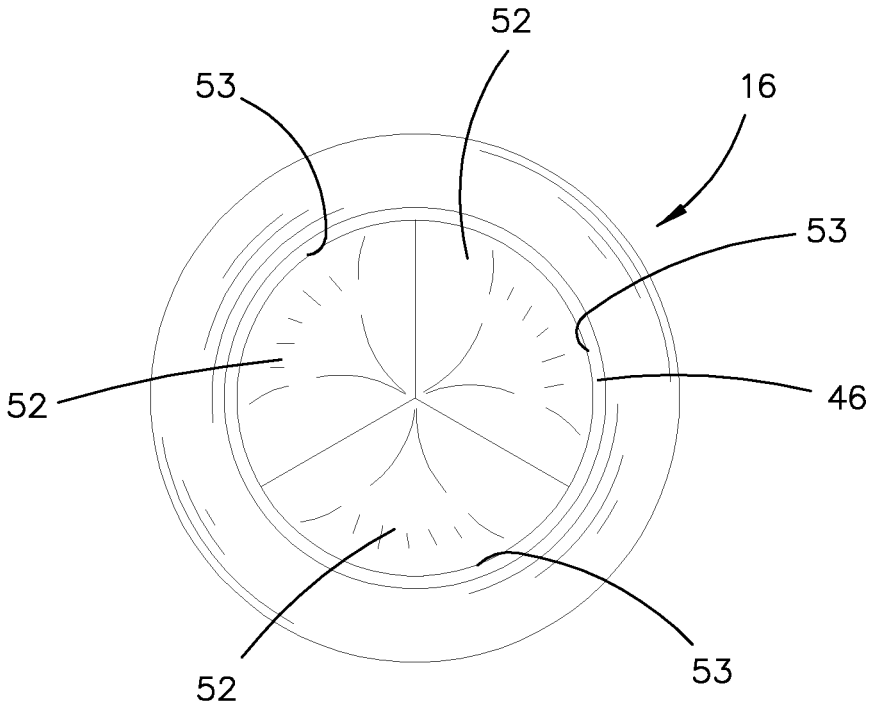
FIG. 4 is a top view of the overmolded tricuspid valve of this invention.
Figure 5:
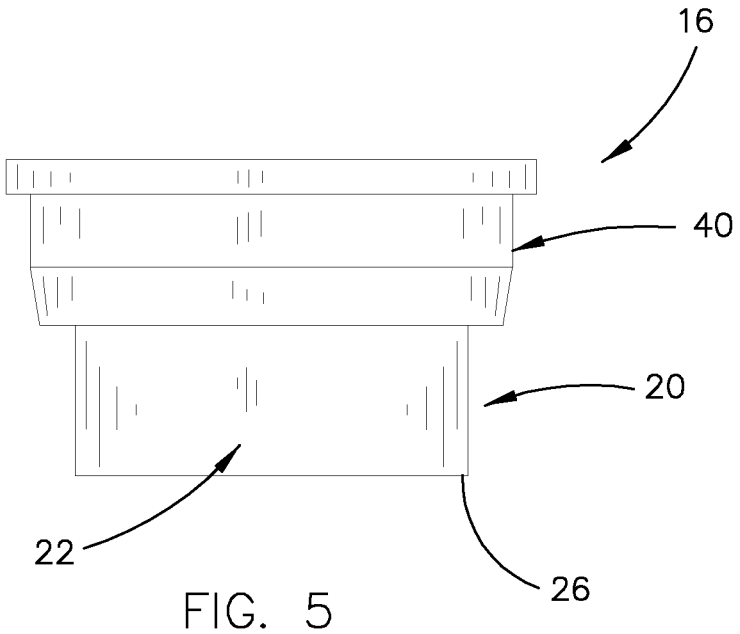
FIG. 5 is a side view of the overmolded tricuspid valve of this invention.
Figure 6:
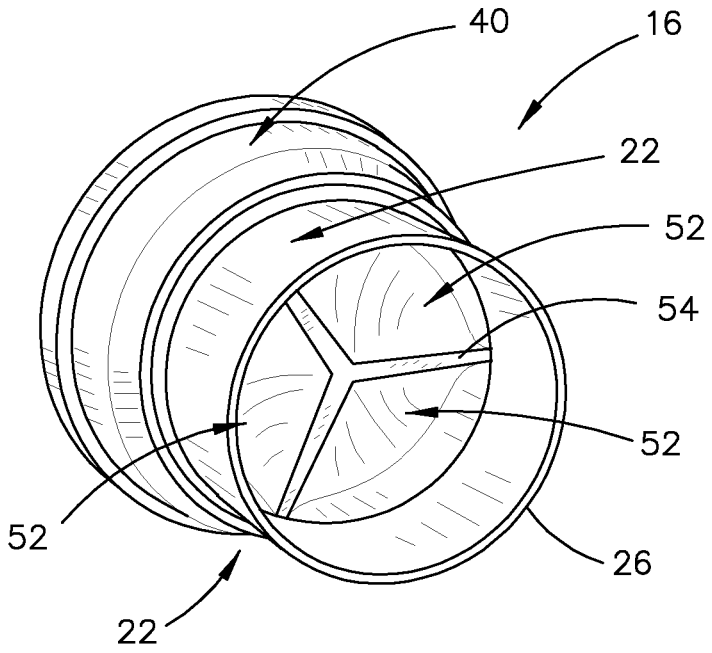
FIG. 6 is a lower perspective view of the overmolded tricuspid valve of this invention.
Figure 7:
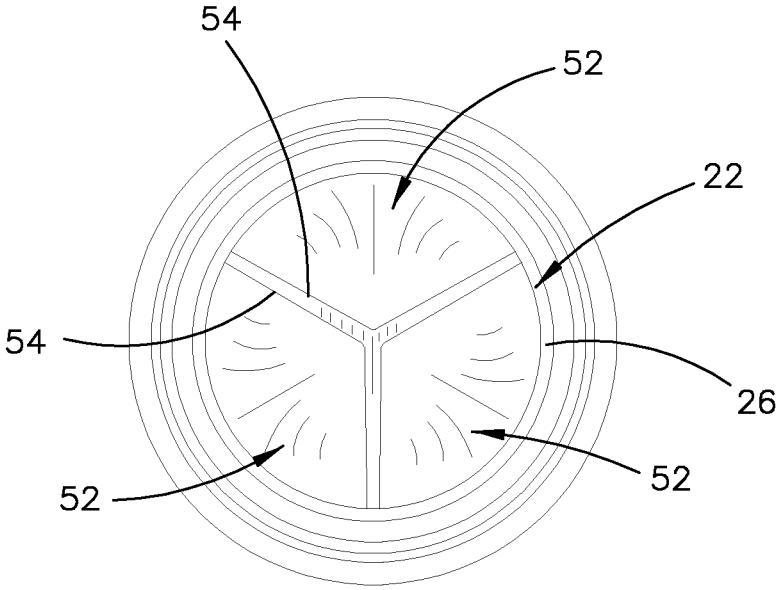
FIG. 7 is a bottom view of the overmolded tricuspid valve of this invention.

The numeral 10 refers to a conventional container such as a bottle or the like which is used for transporting, storing, dispensing and/or dosing liquids therefrom. FIG. 1 illustrates the container 10 in an upright position. In FIG. 1, container 10 includes a hollow throat 12 extending upwardly therefrom. Throat 12 has exterior threads 14. Container 10 is shown in the inverted position in FIGS. 8 and 9.

The numeral 16 refers to the valve of this invention which is inserted into the throat portion 12. Valve 16 seals the throat portion 12. When the container 10 is in the upright transport position or storage position of FIG. 1, valve 16 prevents liquid from flowing upwardly through the throat portion 12. Valve 16 permits liquid in said container to pass upwardly through the valve when the valve is in an open position. A shipping cap 18 is normally threadably secured to the threads 14 of container 10.

The valve 16 will be described in detail as being in the position of FIGS. 1-5. Valve 16 includes a hollow tubular substrate member 20 having an upper cylindrical wall 22 with an upper end 24 and a lower end 26. An annular lip or flange 28 extends outwardly from the upper end 24 of wall 22. An annular shoulder 30 extends inwardly from the lower end 26 of wall 22. Substrate portion 20 includes a lower cylindrical wall 32, having an upper end 34 and a lower end 36, which extends downwardly from the inner end of shoulder 30. As seen, upper cylindrical wall 32 has a diameter which is less than the diameter of upper cylindrical wall 22 thereby creating a recessed portion 38 at the inner side of upper cylindrical wall 22. The substrate portion 20 may be molded from any resin that would act as a structure support to overmolded portion 40 such as polypropylene, polyethylene or PVDF.

The numeral 40 refers to the overmolded portion of valve 16. Overmolded portion 40 includes a cylindrical wall 42 which embraces the outer side of upper cylindrical wall 22. Overmolded portion 40 also includes a portion 44 which embraces lip 28. Overmolded portion 40 further includes a cylindrical wall 46 which extends downwardly from the inner end of portion 44. As seen, the lower end of wall 46 is positioned in the recessed portion 38 at the inner side of upper cylindrical wall 22. Wall 46 has an upper end 48 and a lower end 49.

Upper cylindrical wall 22 has a plurality of radially spaced-apart openings 50 formed therein so that overmolding passes from wall 46, through opening 50 and into wall 42, to securely attach the overmolded portion 40 to the substrate member 20.

The overmolded portion 40 includes 3 flexible cuspids 52 which are molded together. Each of the cuspids 52 is generally triangular in plan view. Each of the cuspids 52 has a semi-circular outer end 53 which is molded to the inside of wall 46. The outer end 53 of each of the cuspids 52 extends downwardly along wall 46. Each of the cuspids 52 have a horizontally disposed lower end 54 which extends inwardly from the lower end of the wall 46. Each of the cuspids 52 have a side edge 56 which extends downwardly from the upper end of wall 46 to lower end 54 of the cuspid 52. The side edges 56 of the cuspids 52 are molded together. The lower ends 54 of the cuspids 52 are molded together. The overmolded resin could be any resin that is soft enough to create a seal and form a valve such as metallocene, TPV, TPU or TPE.

Figure 8:
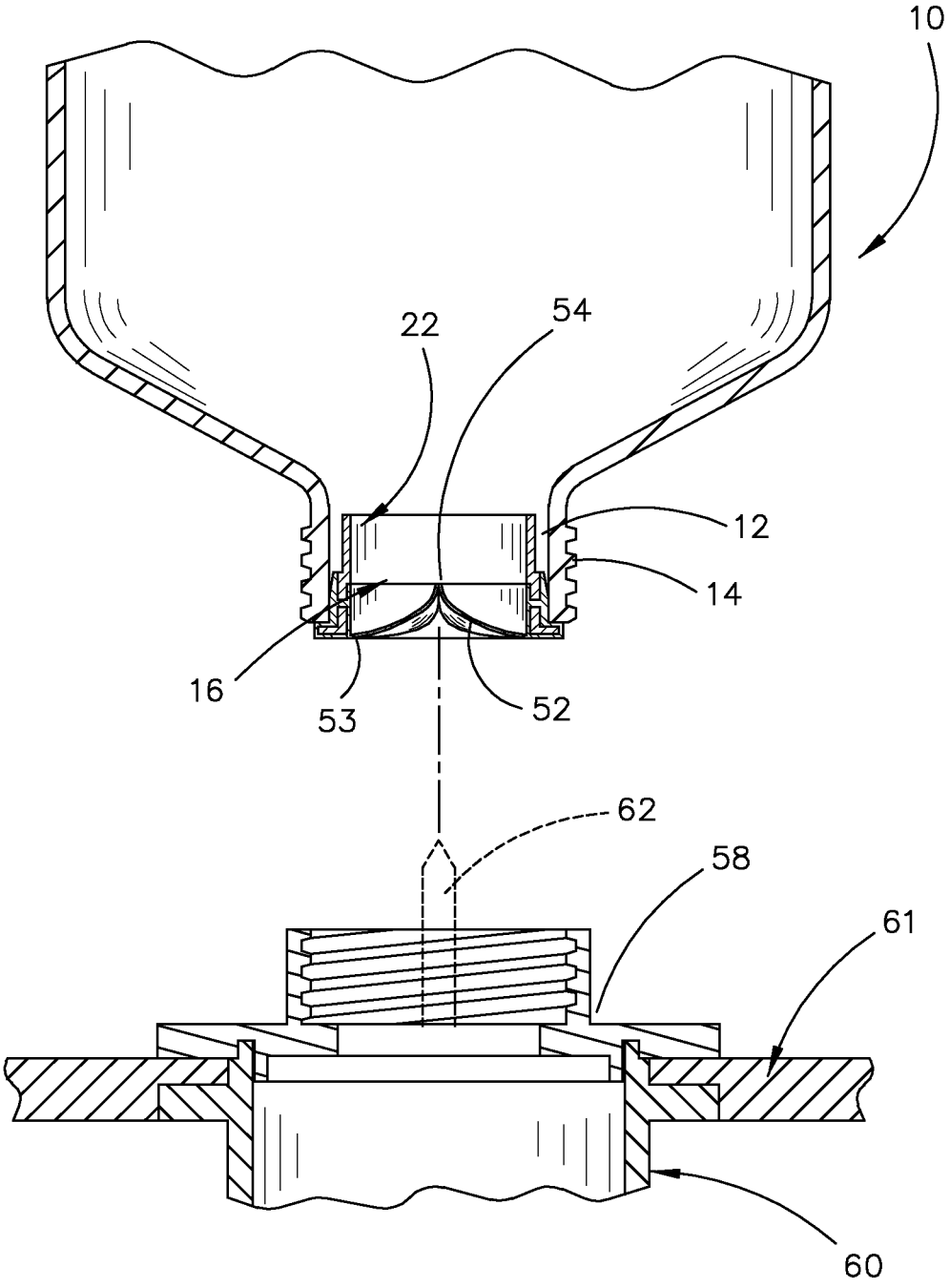
FIG. 8 is a partial exploded sectional view of the overmolded tricuspid valve of this invention in an inverted container and the upper end of a dispensing and/or dosing apparatus.

Thus, when installed in the throat 12 of an upright container 10, the valve 16 prevents the flow of liquid outwardly from the container 10. When the container 10 is inverted as seen in FIG. 8, the valve 16 prevents the downward flow of liquid from the container 10. When sufficient tearing force is applied to the underside of the cuspids 52, the cuspids 52 will tear open to permit liquid to flow downwardly through the valve 16 as long piercing force is applied thereto. When the piercing force is withdrawn, the side edges 56 of the cuspids 52 will join together to prevent liquid from passing downwardly therethrough.

Figure 9:
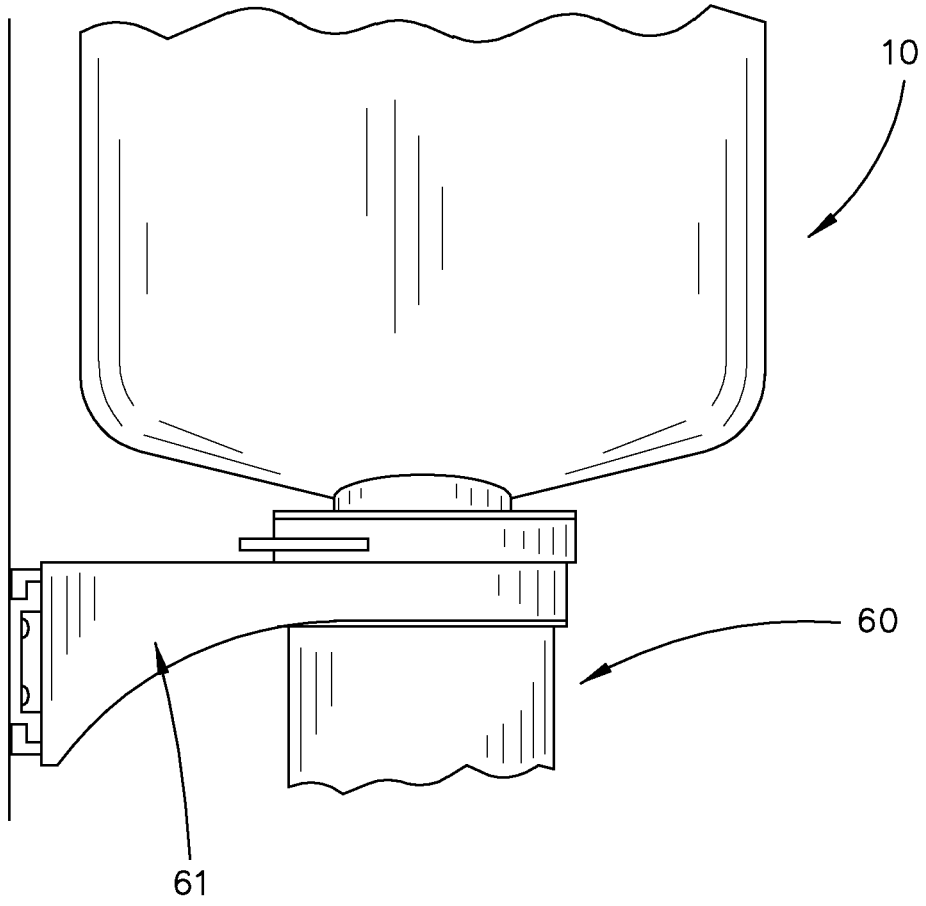
FIG. 9 is a partial side view illustrating the container being in an inverted position and mounted on a wall support.

FIG. 8 illustrates the container 10 in an inverted position and which is mounted on the upper end 58 of a dosing and/or dispensing apparatus 60 mounted on a wall support 61 or the like as seen in FIG. 9. The apparatus 60 is shown to illustrate one method of opening the valve 16. Apparatus 60 may include a lance 62 which is selectively moved upwardly to penetrate and tear the inner ends of the cuspids 52. When the lance 62 has penetrating the cuspids 52 of valve 16, liquid may flow downwardly from the container 10 into the apparatus 60. When the lance 62 is withdrawn from the valve 16, the cuspids 52 return to the closed positions due to the design of the cuspids 52 as stated herein above.

Thus, it can be seen that a novel overmolded tricuspid valve has been provided for a liquid container which is comprised of fewer parts than those of the prior art.

Thus, it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. In combination:

an inverted liquid container having an upper end and a lower end; said lower end of said container having a hollow throat extending downwardly therefrom which has interior and exterior surfaces;

said exterior surface of said throat being threaded; a normally closed tricuspid valve positioned in said throat;

said tricuspid valve having an upper end and a lower end;

said tricuspid valve being movable from said normally closed position to an open position;

said tricuspid valve preventing liquid in said container from passing downwardly therethrough when in said closed position;

said tricuspid valve permitting liquid in said container to pass downwardly therethrough when in said open position;

said tricuspid valve including:

(a) a plastic substrate portion including:

(1) a hollow lower cylindrical wall having an upper end, a lower end, an inner side and an outer side;

(2) a ring-shaped lip extending outwardly from said lower end of said lower cylindrical wall;

(3) an annular shoulder extending inwardly from said upper end of said lower cylindrical wall which has an inner end and an outer end;

(4) a hollow upper cylindrical wall, having an upper end and a lower end, which extends upwardly from said inner end of said shoulder;

(b) a plastic overmolded portion including:

(1) a first cylindrical wall embracing said outer side of said lower cylindrical wall of said substrate portion and which has an upper end and a lower end:

(2) a lower end portion embracing said lip at said lower end of said lower cylindrical wall of said substrate portion;

(3) a second cylindrical wall, having a lower end, an upper end, an inner side and an outer side, extending upwardly from said lower end portion and being positioned at said inner side of said lower cylindrical wall of said substrate portion; and (c) flexible cuspids molded with said second cylindrical wall of said overmolded portion so as to extend therebetween;

said tricuspid valve being normally closed to prevent liquid from passing downwardly therethrough;

said tricuspid valve permitting liquid to flow downwardly therethrough upon an upward force being applied thereto sufficient to create an opening therein; and said tricuspid valve returning to said closed position upon the upward force being discontinued.

2. In combination:

a liquid container having an upper end and a lower end;

said upper end of said liquid container having a hollow throat extending upwardly therefrom;

a normally closed tricuspid valve positioned in said throat of said liquid container;

said tricuspid valve being movable from said normally closed position to an open position;

said tricuspid valve preventing liquid in said container from passing upwardly therethrough when in said closed position; and said tricuspid valve permitting liquid in said container to pass upwardly therethrough when in said open position;

wherein said tricuspid valve includes:

(a) a plastic substrate portion including:

(1) a hollow lower cylindrical wall having an upper end, a lower end, an inner side and an outer side;

(2) a ring-shaped lip extending outwardly from said lower end of said lower cylindrical wall;

(3) an annular shoulder extending outwardly from said upper end of said lower cylindrical wall which has an inner end and an outer end:

(4) a hollow upper cylindrical wall, having an upper end and a lower end, which extends upwardly from said outer end of said shoulder:

(b) a plastic overmolded portion including:

(1) a first cylindrical wall embracing said outer side of said upper cylindrical wall of said substrate portion and which has an upper end and a lower end;

(2) on upper end portion embracing said lip at said upper end of said upper cylindrical wall of said substrate portion;

(3) a second cylindrical wall, having a lower end, an upper end, an inner side and an outer side, extending downwardly from said upper end portion and being positioned at said inner side of said upper cylindrical wall of said substrate portion; and (c) flexible cuspids molded with said second cylindrical wall of said overmolded portion so as to extend therebetween.

* * * * *